United States Patent [19]

Inoue et al.

[11] Patent Number: 4,826,408

[45] Date of Patent: May 2, 1989

[54] TWO-CYLINDER ROTARY COMPRESSOR AND METHOD FOR MANUFACTURING THE SAME

[75] Inventors: Toshinobu Inoue; Tsugio Itami, both of Numazu, Japan

[73] Assignee: Kabushiki Kaisha Toshiba, Kawasaki, Japan

[21] Appl. No.: 139,309

[22] Filed: Dec. 29, 1987

[30] Foreign Application Priority Data

Feb. 19, 1987 [JP] Japan ..... 62-36728

[51] Int. Cl.[4] ..... F04C 18/356; F04C 23/00; B23P 15/00

[52] U.S. Cl. ..... 418/60; 418/63; 29/156.4 R; 29/467; 29/469

[58] Field of Search ..... 418/60, 63, 212; 29/156.4 R, 434, 467, 469

[56] References Cited

U.S. PATENT DOCUMENTS 2,758,546 8/1956 Gillette ..... 418/60

FOREIGN PATENT DOCUMENTS 46-65 7/1971 Japan .
51-151875 12/1976 Japan .
52-109604 9/1977 Japan .
53-90002 8/1978 Japan .
53-103211 9/1978 Japan .
53-116579 10/1978 Japan .
59-25880 6/1984 Japan .
61-286596 12/1986 Japan ..... 418/60

*Primary Examiner*—John J. Vrablik
*Attorney, Agent, or Firm*—Cushman, Darby & Cushman

[57] ABSTRACT

A two-cylinder rotary compressor includes a closed casing, a compression section, and an electric motor section, both arranged in the casing, for driving the compression section. The compression section comprises first and second assemblies. The first assembly is constructed by securing a first cylinder to a first bearing, in alignment therewith. The second assembly is constructed by securing a second cylinder to a second bearing, in alignment therewith. The first and second assemblies are aligned with and secured to each other while a partitioning plate is interposed between the first and second cylinders. First and second rollers are rotatably arranged in the first and second cylinders, respectively. These rollers are rotated by a rotational shaft which is supported by the first and second bearings and driven by the electric motor section.

9 Claims, 3 Drawing Sheets

TWO-CYLINDER ROTARY COMPRESSOR AND METHOD FOR MANUFACTURING THE SAME

BACKGROUND OF THE INVENTION

The present invention relates to a two-cylinder rotary compressor having two compression chambers, and a method for manufacturing the same.

A two-cylinder rotary compressor, wherein two compression chambers are located along a rotational shaft, is well known as one of closed-type rotary compressors. The compression section of the compressor includes a first bearing, a first cylinder, a partitioning plate, a second cylinder, and a second bearing. These components are stacked on one another in the order mentioned. As in a single-cylinder rotary compressor, the rotational shaft of the two-cylinder rotary compressor extends through the first and second cylinders, and is rotatably supported thereby. A medium is compressed by eccentrically rotating a roller in each cylinder by means of the rotational shaft.

Japanese Patent Publication [Kokoku] No. 59-25880 discloses how to fasten compression section having the above structure. According to this reference, a first bearing and a first cylinder are aligned and secured to each other by means of first bolts. Then, a rotational shaft and a first roller are installed with reference to the secured first bearing and first cylinder. Thereafter, a partitioning plate is aligned with the first cylinder and secured to it by means of second bolts. Subsequently, a second cylinder is aligned with the partitioning plate and is then secured to it by a plurality of bolts. After mounting a second roller with reference to the second cylinder, a second bearing is aligned with the second cylinder and is then secured to it.

In the compression section which is assembled by stacking the components on the first bearing, two adjacent components can be aligned with each other with high accuracy. Even if there is an error in the alignment between the adjacent components, the error itself would not cause a serious problem in practice. However, such errors will be added together during the process of stacking the components, with the result that the first and second cylinders tend to be greatly misaligned. If the first and second bearings are not aligned with high accuracy, the reliability and efficiency of the compressor will deteriorate. In addition, as long as the components are secured one after another with reference to the first bearing, the assembly of the compression section is troublesome and cannot be performed with high efficiency.

SUMMARY OF THE INVENTION

The present invention has been developed in consideration of the above circumstances, and its object is to provide a two-cylinder rotary compressor in which the components can be positioned with high accuracy and which can be manufactured with high efficiency. Another object of the invention is to provide a method for manufacturing the two-cylinder rotary compressor.

To achieve the first object, a two-cylinder rotary compressor of the invention comprises: a closed casing, a compression section located within the casing, and an electric motor section arranged in the casing and having a rotational shaft, for driving the compression section. The compression section comprises: a first assembly including a first bearing, and a first cylinder secured in alignment with the first bearing; a second assembly including a second bearing, and a second cylinder secured in alignment with the second bearing; and a partitioning plate. In the compression section, the second assembly and the partitioning plate are secured to the first assembly such that they are in alignment with the first assembly and that the partitioning plate is located between the first and second cylinders. The rotational shaft extends through the first and second cylinders and is rotatably supported by the first and second bearings. The compression section further comprises a first roller located in the first cylinder and eccentrically rotated by the rotational shaft, and a second roller located in the second cylinder and eccentrically rotated by the rotational shaft.

A manufacturing method according to the present invention comprises the steps of: forming a first assembly by securing a first cylinder to a first bearing alignment therewith; installing both a rotational shaft and a first eccentric roller with reference to the first assembly; forming a second assembly by securing a second cylinder to a second bearing in alignment therewith; and aligning both the second assembly and a partitioning plate with the first assembly, with the rotational shaft and a second eccentric roller being installed in the second assembly, and then securing both the partitioning plate and the second assembly to the first assembly such that the partitioning plate is interposed between the first and second cylinders.

BRIEF DESCRIPTION OF THE DRAWINGS

FIGS. 1 through 6 illustrate a compressor according to one embodiment of the present invention: wherein FIG. 1 is a longitudinal sectional view of the compressor, and FIGS. 2–6 are sectional views illustrating the manufacturing process of a compression section of the compressor.

DETAILED DESCRIPTION OF THE PREFERRED EMBODIMENT

An embodiment of the present invention will now be described, with reference to the accompanying drawings.

Figure 1:
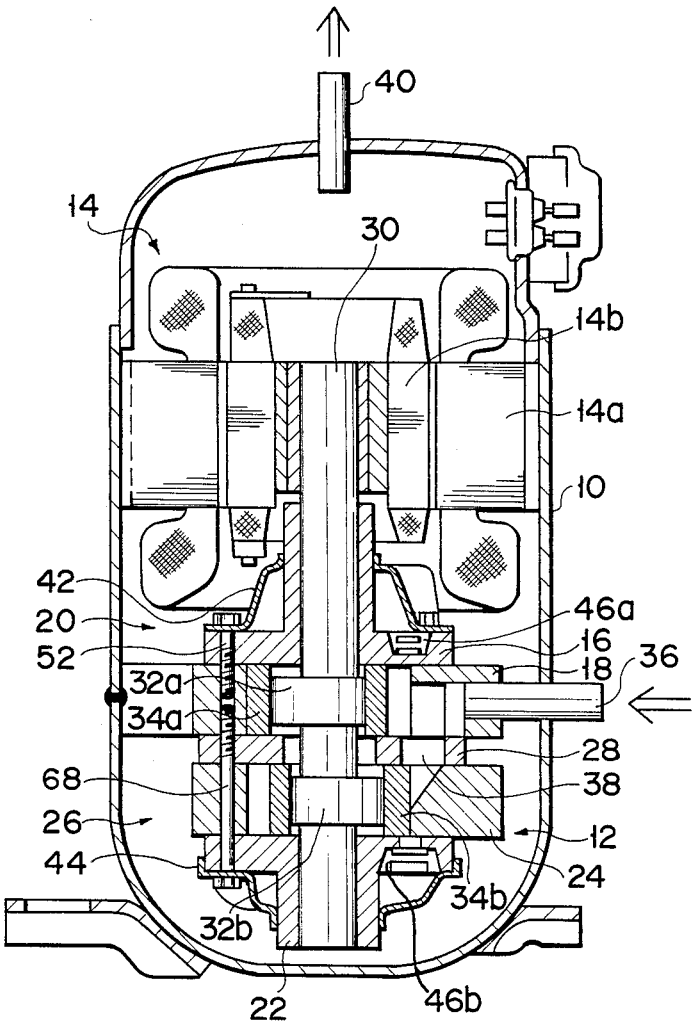

As is shown in FIG. 1, a two-cylinder rotary compressor according to this embodiment comprises closed casing 10, compression section 12 located in the lower region of casing 10, and electric motor section 14 located in the upper region of casing 10, for driving compression section 12. Electric motor section 14 includes annular stator **14*a* secured to the inner surface of casing 10, and rotor 14*b* located within annular stator 14*a***.

Compression section 12 comprises first and second assemblies 20 and 26. First assembly 20 includes main bearing 16, and first cylinder 18 secured to main bearing 16. Second assembly 26 includes auxiliary bearing 22, and second cylinder 24 secured to auxiliary bearing 22. First and second assemblies 20 and 26 are coaxially connected to each other while partitioning plate 28 is interposed between first and second cylinders 18 and 24. First and second cylinders 18 and 24 are partially secured to the inner surface of casing 10. Rotational shaft 30 extends through the compression chambers defined in first and second cylinders 18 and 24, and is rotatably supported by main and auxiliary bearings 16 and 22. The upper end of shaft 30 is attached to rotor **14*b* of electric motor section 14, so that shaft 30 can be rotated by section 14. Shaft 30 includes eccentric portions 32***a* and 32*b*, which are located in the compression chambers of first and second cylinders 18 and 24, respectively. Rollers 34*a* and 34*b* are fitted around the outer periphery of eccentric portions 32*a* and 32*b*, respectively. When shaft 30 is driven, rollers 34*a* and 34*b* are eccentrically rotated in the compression chambers of cylinders 18 and 24. The compression chamber of each cylinder is partitioned into a suction region and a discharge region by means of blade (not shown), which reciprocates in accordance with the rotation of the corresponding roller. With the above structure, compression section 12 is driven by use of the torque produced by electric motor section 14, thereby performing compression of a medium.

Suction tube 36, which extends through casing 10, is connected to first cylinder 18, and communicates with the suction region of the compression chamber of cylinder 18. Suction tube 36 also communicates with the suction region of the compression chamber of second cylinder 24, via suction passage 38 formed in both cylinder 24 and partitioning plate 28. Discharge tube 40, which communicates with the interior of casing 10, is provided at the top of casing 10. Valve covers 42 and 44, serving also as a silencer, are attached to main and auxiliary bearings 16 and 22, respectively. Discharge valve mechanisms 46*a* and 46*b*, used for discharging a medium, are provided at bearings 16 and 22, respectively. The medium (e.g., a refrigerating gas) compressed in the compression chamber of cylinder 18 is discharged from the compressor, via valve mechanism 46*a*, the interior of valve cover 42, the interior of casing 10, and discharge tube 40. Likewise, the medium compressed in the compression chamber of cylinder 24 is discharged from the compressor, via valve mechanism 46*b*, the interior of valve cover 44, the interior of casing 10, and discharge tube 40.

The construction of compression section 12 will be described in more detail, in connection with the assembling method thereof.

Figure 2:
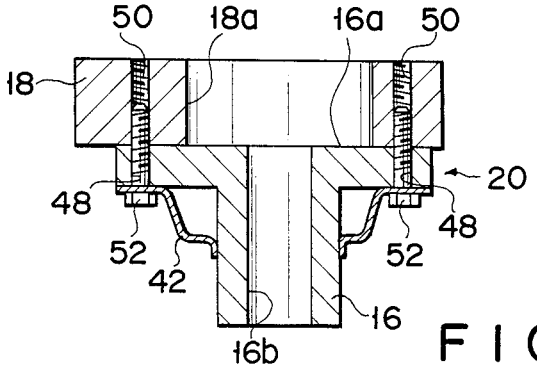

A description will be given of how to prepare first assembly 20. As is shown in FIG. 2, main bearing 16 is positioned by use of a suitable jig (not shown) such that the upside of the bearing is turned down. More specifically, main bearing 16 is kept horizontal, with its junction surface 16*a* facing upward. Main bearing 16 is provided with axial opening 16*b* and a plurality of through-holes 48 arranged around opening 16*b* and spaced from each other at regular intervals. Through holes 48 are formed at predetermined positions with the central axis of axial opening 16*b* as a reference. The diameter of each through hole 48 is approximately 10% larger than the diameter of corresponding threaded hole 50. Next, first cylinder 18 is stacked on junction surface 16*a* of bearing 16 and aligned with bearing 16. At this time, first cylinder 18 is positioned such that its threaded holes 50, which are arranged in the circumferential direction to be spaced from each other at regular intervals, come to the locations of through-holes 48 of bearing 16. Cylinder 18 is aligned with bearing 16 on the basis of axial opening 16*b* so that the compression chamber 18*a* of cylinder 18 is positioned coaxial with the axial opening 16*b* as follows:

First of all, a reference shaft (not shown), which has the same diameter as shaft 30, is inserted through compression chamber 18*a* of cylinder 18 into axial opening 16*b* of bearing 16. Under this condition, cylinder 18 is moved, in directions parallel to two reference lines X and Y which are perpendicular to each other, within a plane perpendicular to the reference shaft. Specifically, cylinder 18 is moved in one direction parallel to line X until the inner face of cylinder 18 abuts the reference shaft. From the point where the inner face abuts the reference shaft, cylinder 18 is moved in the opposite direction parallel to line X until the inner face abuts the reference shaft again. In this manner, distance A for which cylinder 18 moves in the opposite direction is measured. Assuming that the half of distance A indicates the center of axial opening 16*b*, cylinder 18 is moved for distance A/2 in the one direction parallel to line X, thereby positioning cylinder 18 with respect to line X. Thereafter, cylinder 18 is positioned in direction parallel to line Y by repeating similar procedures, thereby aligning cylinder 18 with bearing 16. Thus, compression chamber 18*a* is accurately positioned coaxially with axial opening 16*b*. After this alignment, valve cover 42 is attached to bearing 16. From under valve cover 42, first bolt 52 is screwed into threaded hole 50 of cylinder 18 through a through-hole formed in valve cover 42 and through-hole 48 formed in bearing 16. As a result, bearing 16 and cylinder 18 are fastened to each other, together with valve cover 42.

Figure 3:
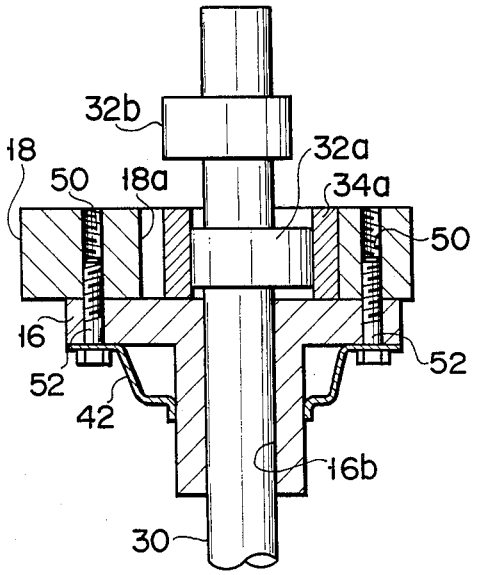

Thereafter, as is shown in FIG. 3, a blade and roller 34*a* are installed in compression chamber 18*a* of first cylinder 18, and shaft 30 is inserted into axial opening 16*b* of bearing 16 through compression chamber 18*a*.

Figure 4:
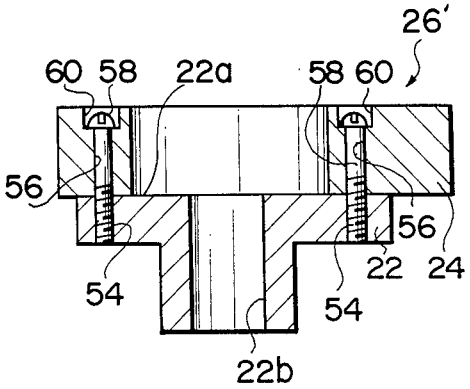
Figure 5:
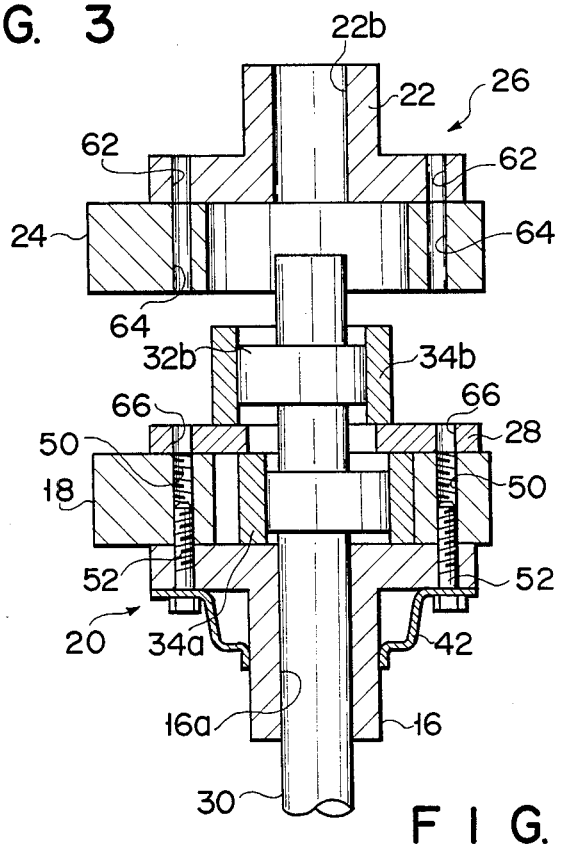

Second assembly 26 is prepared, independently of first assembly 20 mentioned above. As is shown in FIG. 4, auxiliary bearing 22 is positioned by use of a suitable jig (not shown) such that its junction surface 22*a* faces upward. Auxiliary bearing 22 is provided with axial opening 22*b* and a plurality of threaded holes 54. The threaded holes are arranged around axial opening 22*b* and spaced from each other at regular intervals. Cylinder 24 is provided with a plurality of through-holes 56 formed at locations corresponding to those of threaded holes 54. The diameter of each through hole 56 is approximately 10% larger than the diameter of the threaded hole 54. Then, cylinder 24 is stacked over bearing 22 such that its through-holes 56 come to the locations of threaded holes 54. Thereafter, cylinder 24 is aligned with bearing 22 on the basis of axial opening 22*b* so that the inner hole, i.e., the compression chamber of the cylinder 24, is accurately positioned coaxial with axial opening 22*b*. Under this condition, second screw 58 is screwed from above cylinder 22 into threaded hole 54 through through-hole 56, thereby fastening cylinder 24 and bearing 22 to each other. Each through-hole 56 has larger diameter portion 60 at the upper region. When cylinder 24 and bearing 22 are fastened to each other, therefore, the head of second screw 58 is housed in large-diameter region 60 so that it does not project from cylinder 24. As is shown in FIG. 5, bearing 22 is provided with a plurality of through-hole 62, which are formed before cylinder 24 is aligned with bearing 22 and are shifted from threaded holes 54 in the circumferential direction of bearing 22. Likewise, cylinder 24 is provided with a plurality of through-holes 64, which are formed before cylinder 24 is aligned with bearing 22 and are shifted from through-holes 56 in the circumferential direction of cylinder 24. After bearing 22 and cylinder 24 are fastened together, each through-hole 62 coaxially communicates with corresponding through-hole 64. The diameters of through holes 62 and 64 are approximately 10% larger than the diameter of the corresponding threaded hole 50.

Thereafter, partitioning plate 28 is placed on the upper face of cylinder 18 of first assembly 20 and second roller **34*b* is fitted around the outer periphery of eccentric portion 32*b* of shaft 30, as is shown in FIG. 5. Partitioning plate 28 is provided with a plurality of through-holes 66, and placed on first cylinder 18 such that through-holes 66 come to the locations of threaded holes 50 of cylinder 18. Then, second assembly 26 is stacked over partitioning plate 28 after a blade (not shown) is installed in the compression chamber of cylinder 24. At this time, second assembly 26 is stacked such that shaft 30 and roller 34*b* are inserted into axial opening 22*b* of bearing 22 and the compression chamber of cylinder 24, respectively, and through-holes 62 and 64 come to the locations of through-holes 66 of partitioning plate 28. Under this condition, partitioning plate 28 and second assembly 26 are aligned with first assembly 20, particularly on the basis of axial opening 16*a* of main bearing 15 so that axial opening 22*b* of bearing 22 is accurately positioned coaxial with axial opening 16*a***.

Figure 6:
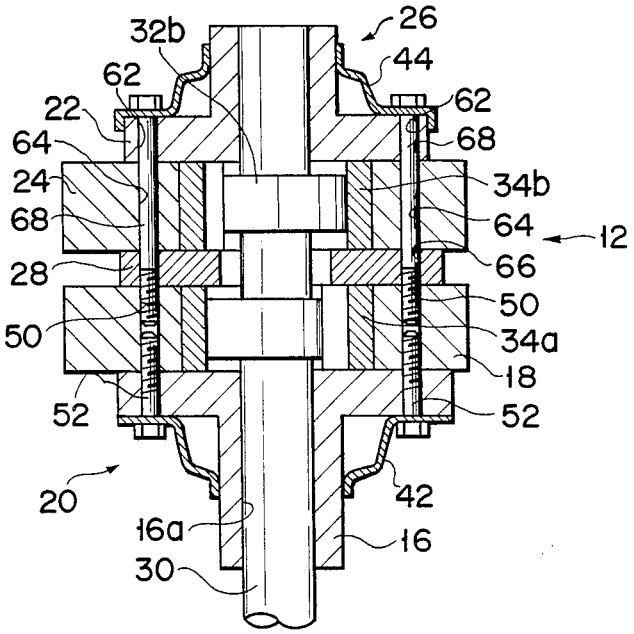

Thereafter, valve cover 44 is fitted to auxiliary bearing 22, as is shown in FIG. 6. Subsequently, third bolt 68 is screw from above valve cover 44 into threaded hole 50 of first cylinder through valve cover 44, through-holes 62, 64, and 66. In this manner, valve cover 44, second assembly 26, and partitioning plate 28 are fastened to first assembly 20, thus completing the assembly of compression section 12.

The embodiment constructed as described above has the following advantages.

As mentioned above, first assembly 20 is constructed by fastening first cylinder 18 to main bearing 16 in alignment therewith. Likewise, second assembly 24 is constructed by fastening second cylinder 24 to auxiliary bearing 22 in alignment therewith. Compression section 12 is formed by fastening these assemblies together in alignment with each other. As a result of this manufacturing process, both auxiliary bearing 22 and second cylinder 24 can be fastened to main bearing 16 while maintaining very accurate alignment with main bearing 16. In the prior art of the present invention, in contrast, components are assembled one after another with reference to a main bearing. During this assembling process, errors in the alignment between the two adjacent components are added together, with the result that the component finally assembled tends to be misaligned with the main bearing. The present invention is free of this problem.

In the compressor of the embodiment, the clearances associated with each cylinder can be determined with high accuracy, as can be understood from the above. Therefore, the performance and reliability of the compressor can be improved remarkably.

Furthermore, first and second assemblies 20 and 26 can be manufactured independently of each other, thereby permitting the compressor to be assembled with high efficiency. Still further, main bearing 16, second cylinder 24, and partitioning plate 28 need not have threaded holes, so that the number of manufacturing steps can be reduced and the manufacturing cost of the compressor can be reduced.

The present invention is not limited to the above embodiment and various changes and modifications may be effected therein by one skilled in the art without departing from the scope of this invention.

Figure 7:
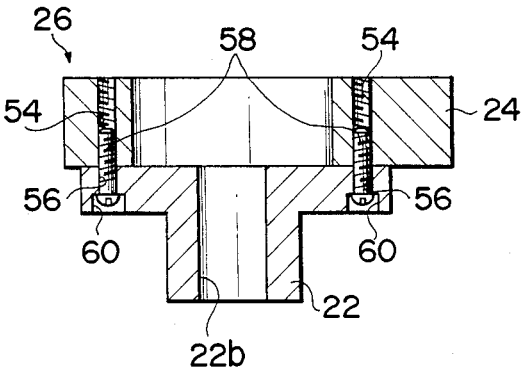
FIG. 7 is a sectional view illustrating a modification of the manufacturing process.

For example, the present invention is not limited to a vertical rotary compressor, such as that mentioned above. It can be applied to a horizontal rotary compressor. In addition, second assembly 26 need not be made in the manner mentioned above. It can be alternatively made as follows:

As is shown in FIG. 7, through-hole 56 having large-diameter portion 60 is formed in auxiliary bearing 22, and threaded hole 54 is formed in second cylinder 24. Second screw 58 is screwed from auxiliary bearing 22 into threaded hole 54 through through-hole 56, thereby fastening cylinder 24 and bearing 22 to each other. In this alternative method, valve cover 44 can also be secured to auxiliary bearing 22 by means of screws 58. If valve cover 44 is secured in this way, through-hole 56 need not have large-diameter region 60 for receiving the head of screw 58.

What is claimed is:

1. A two-cylinder rotary compressor, comprising:

a closed casing;

a compression section located within the casing; and an electric motor section for driving the compression section, the electric motor section being located within the casing and having a rotational shaft, the compression section including:

a first assembly including a first bearing having an axial opening into which one end of the rotational shaft is inserted, and a first cylinder having an inner hole defining a first compression chamber and secured to the first bearing, by a plurality of first fasteners, in alignment therewith so that the first compression chamber is positioned coaxial with the axial opening;

a second assembly including a second bearing having an axial opening into which the other end of the rotational shaft is inserted, and a second cylinder having an inner hole defining a second compression chamber and secured to the second bearing by a plurality of second fasteners, in alignment therewith so that the second chamber is positioned coaxial with the axial opening of the second bearing;

a partitioning plate; the second assembly and the partitioning plate being secured to the first assembly by a plurality of third fasteners, in alignment with the first assembly so that the axial opening of the second bearing is positioned coaxial with the axial opening of the first bearing, the partitioning plate being located between the first and second cylinders, and the rotational shaft extending through the first and second cylinders and being rotatably supported by the first and second bearings;

a first roller, located in the compression chamber of the first cylinder and eccentrically rotated by the rotational shaft; and a second roller, located in the compression chamber of the second cylinder and eccentrically rotated by the rotational shaft.

2. A compressor according to claim 1, wherein said compression section includes a first valve cover secured to the first bearing by means of the first fasteners, and a second valve cover secured to the second bearing by means of the third fasteners.

3. A compressor according to claim 2, wherein the first bearing is provided with a plurality of first through-holes, the first cylinder is provided with a plurality of first threaded holes aligned with the corresponding first through-holes, and the first fasteners include first screws each screwed from the first bearing into the corresponding first threaded hole, through the corresponding first through-hole.

4. A compressor according to claim 3, wherein said second bearing is provided with a plurality of second through-holes, the second cylinder is provided with a plurality of third through-holes aligned with the corresponding second through-holes, the partitioning plate is provided with a plurality of fourth through-holes aligned with the threaded holes of the first cylinder and the third through-holes, and the their fasteners include third screws each screwed from the second bearing into the corresponding threaded hole, through the respective second, third, and fourth through-holes.

5. A compressor according to claim 4, wherein said second bearing is provided with a plurality of threaded holes arranged alternately with the second through-holes, the second cylinder is provided with a plurality of fifth through-holes aligned with the corresponding threaded holes of the second bearing, and the second fasteners include second screws each screwed from the second cylinder into the corresponding threaded hole of the second bearing through the corresponding fifth through-hole, each fifth through-hole having a large-diameter region for receiving the head of one of the second screws.

6. A method for manufacturing a compression section of a two-cylinder rotary compression, comprising the steps of:

forming a first assembly by securing a first cylinder with a first compression chamber to a first bearing with an axial opening by a plurality of first fasteners, in alignment therewith so that the first compression chamber is positioned coaxial with the axial opening;

installing both a rotational shaft and a first eccentric roller in the first assembly;

forming a second assembly by securing a second cylinder with a second compression chamber to a second bearing with an axial opening by a plurality of second fasteners, in alignment therewith so that the second compression chamber is positioned coaxial with the axial opening of the second bearing; and aligning both the second assembly and a partitioning plate with the first assembly so that the axial opening of the second bearing is positioned coaxial with the axial opening of the first bearing, with rotational shaft and a second eccentric roller being installed in the second assembly, and then, by a plurality of third fasteners, securing both the partitioning plate and the second assembly to the first assembly such that the partitioning plate is interposed between the first and second cylinders.

7. A method according to claim 6, wherein said step of forming the first assembly includes: a process of forming a plurality of first through-holes in the first bearing; a process of forming a plurality of threaded holes in the first cylinder, so as to be conformable with the first through-holes; and a process of aligning the first bearing and the first cylinder with each other and then fastening the first bearing and the first cylinder to each other by screwing a first screw from the first bearing into each threaded hole through the corresponding first through-hole.

8. A method according to claim 7, wherein said step of forming the second assembly includes: a process of forming a plurality of second through-holes in one of the second bearing and second cylinder; a process of forming a plurality of threaded holes in whichever of the second bearing or second cylinder the second through-holes are not formed; and a process of first aligning the second bearing and the second cylinder with each other such that the second through-holes and the threaded holes conform with each other and then fastening the second bearing and the second cylinder to each other by screwing a second screw into each threaded hole through the corresponding second through-hole.

9. A method according to claim 8, wherein said step of fastening the second assembly to the first assembly includes: a process of forming a plurality of third through-holes in the second bearing; a process of forming a plurality of fourth through-holes in the second cylinder, so as to conform with the third through-holes; a process of forming a plurality of fifth through-holes in the partitioning plate, so as to conform with both the fourth through-holes of the second cylinder and the threaded holes of the first cylinder; and a process of first aligning both the partitioning plate and the second assembly with the first assembly and then fastening both the partitioning plate and the second assembly to the first assembly by screwing a third screw from the second bearing into each threaded hole of the first cylinder through the corresponding third to fifth through-holes.

* * * * *